US005794182A

United States Patent [19]

Manduchi et al.

[11] Patent Number: 5,794,182

[45] Date of Patent: Aug. 11, 1998

[54] LINEAR PREDICTIVE SPEECH ENCODING SYSTEMS WITH EFFICIENT COMBINATION PITCH COEFFICIENTS COMPUTATION

[75] Inventors: Roberto Manduchi, San Francisco; Dulce Ponceleon, Palo Alto; Ke-Chiang Chu, Saratoga; Hsi-Jung Wu, Mountain View, all of Calif.

[73] Assignee: Apple Computer, Inc., Cupertino, Calif.

[21] Appl. No.: 724,174

[22] Filed: Sep. 30, 1996

[51] Int. Cl.[6] ..... G10L 9/00

[52] U.S. Cl. ..... 704/219; 704/223; 704/262; 704/220; 704/230; 704/222

[58] Field of Search ..... 704/219, 223, 704/262, 220, 230, 207

[56] References Cited

U.S. PATENT DOCUMENTS

| | | | |
|---|---|---|---|
| 4,944,013 | 7/1990 | Gouvianakis | 381/38 |
| 5,091,945 | 2/1992 | Kleijn | 381/36 |
| 5,142,584 | 8/1992 | Ozawa | 381/36 |
| 5,230,036 | 7/1993 | Akamine | 704/219 |
| 5,455,888 | 10/1995 | Iyengar | 704/219 |
| 5,481,739 | 1/1996 | Staats | 395/800 |
| 5,574,823 | 11/1996 | Hassanein | 704/205 |
| 5,596,676 | 1/1997 | Swaminathan | 704/219 |
| 5,642,464 | 6/1997 | Yue | 704/219 |
| 5,664,055 | 9/1997 | Kroon | 704/223 |

*Primary Examiner*—David R. Hudspeth
*Assistant Examiner*—Daniel Abebe
*Attorney, Agent, or Firm*—Sawyer & Associates

[57] ABSTRACT

Method and system aspects for linear predictive speech encoding are disclosed. These aspects comprise the definition of an error function, the computation of an optimal vector of continuous pitch coefficients together with an optimal pitch, and the weighted vector quantization of the continuous pitch coefficients. The techniques allows the faster computation of the optimal combination pitch—continuous coefficient values without substantial loss of optimal results.

12 Claims, 5 Drawing Sheets

LINEAR PREDICTIVE SPEECH ENCODING SYSTEMS WITH EFFICIENT COMBINATION PITCH COEFFICIENTS COMPUTATION

FIELD OF THE INVENTION

The present invention relates to speech encoding systems, and more particularly to combination pitch-coefficient determinations in linear predictive speech encoding systems.

BACKGROUND OF THE INVENTION

Digital speech processing typically can serve several purposes in computers. In some systems, speech signals are merely stored and transmitted. Other systems employ processing that enhances speech signals to improve the quality and intelligibility. Further, speech processing is often utilized to generate or synthesize waveforms to resemble speech, to provide verification of a speaker's identity, and/or to translate speech inputs into written outputs.

In some speech processing systems, speech coding is performed to reduce the amount of data required for signal representation, often with analysis by synthesis adaptive predictive coders, including various versions of vector or code-excited coders. In the predictive systems, models of the vocal cord shape, i.e., the spectral envelope, and the periodic vibrations of the vocal cord, i.e., the spectral fine structure of speech signals, are typically utilized and efficiently performed through slowly, time-varying linear prediction filters.

In general, linear predictive speech encoding systems employ a model for generation of a speech signal. Generation typically occurs with a speech signal being encoded, transmitting the codes for the signal, and decoding the codes to provide a decoded speech signal, which should be similar to the encoded speech signal. The model employed by the system has parameters, which the linear predictive coding analysis attempts to understand, and needs input in the form of an excitation sequence. A main objective is to determine the best parameters and the best excitation sequence for the model. Unfortunately, determining the best parameters is typically computationally intensive, which can be time-consuming and expensive. Accordingly, what is needed is a more efficient linear predictive encoding system that reduces the computational burden of parameter determinations.

SUMMARY OF THE INVENTION

A method and system for linear predictive speech encoding is disclosed. The method and system comprises the definition of an error function, the computation of an optimal vector of continuous pitch coefficients together with an optimal pitch, and the weighted vector quantization of the continuous pitch coefficients.

In accordance with these aspects of the present invention, a more efficient determination of predictive speech encoding in a speech processing system is achieved. Further, the techniques allows the faster computation of the optimal combination pitch—continuous coefficient values without substantial loss of optimal results. These and other advantages of the present invention are more fully appreciated when taken with the following description and accompanying drawings.

DESCRIPTION OF THE INVENTION

The present invention relates to combination pitch-coefficient determinations in linear predictive speech encoding systems. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown but is to be accorded the widest scope consistent with the principles and features described herein.

Figure 1:
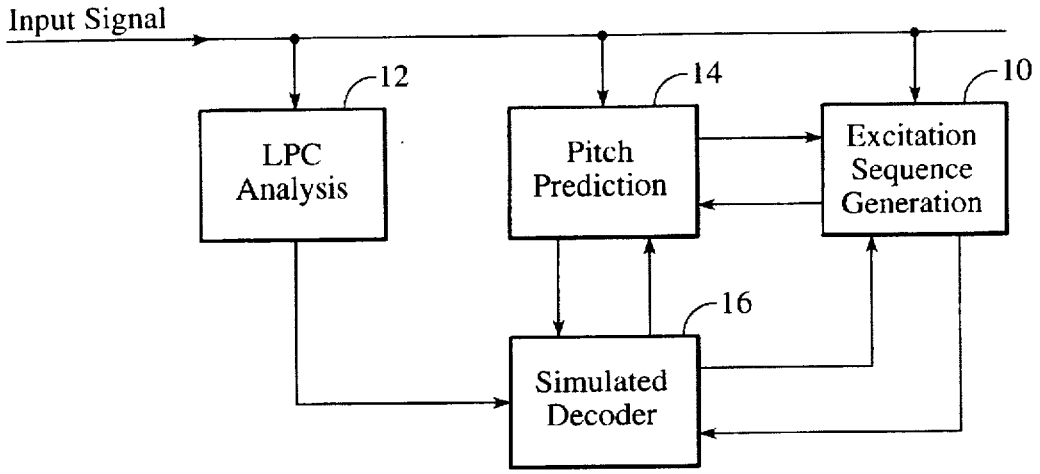
FIG. 1 (PRIOR ART)
FIG. 1 illustrates a block diagram of encoding operations in an analysis-by-synthesis linear predictive coding strategy.

Encoding in linear predictive systems that employ an analysis-by-synthesis strategy is illustrated generally by the schematic of FIG. 1. From a segment/frame of a given number of samples, N, e.g., N=240, of an input signal of digitized speech being encoded, the parameters of a linear predictive scheme based on short term analysis are extracted, as is well understood by those skilled in the art. The parameters extracted determine an all-pole digital filter, i.e., the model for the system, which generates the synthesized signal when fed by a suitable excitation sequence, as from an excitation sequence generator 10. As further shown, the system includes linear predictive coefficient analysis 12, as determined using conventional Levinson-Durbin recursion, pitch predictor 14, which is described in more detail for a conventional technique with reference hereinbelow to FIG. 4, and simulated decoder/synthesis filter 16, which as its name implies, simulates the activity of the decoder of the system and provides useful information to the coder.

Figure 2:
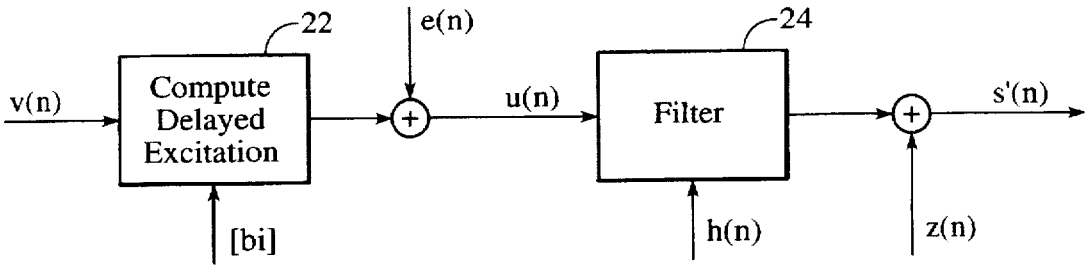
FIG. 2 (PRIOR ART)
FIG. 2 illustrates a block diagram of decoding operations in an analysis-by-synthesis linear predictive coding strategy.

FIG. 2 illustrates decoding operations, simulated by simulated decoder 16, for the formation of a synthesized signal. This encoding-decoding strategy is at the basis of several schemes described in the literature, for example, as described in "Dual Rate Speech Coder for Multimedia Communications Transmitting at 5.3 & 6.3 Kbit/s—International Telecommunication Union Recommendation G.723". The synthesized speech signal in the current frame is thus suitably represented by the formula $$s'(n) = \sum_{m=0}^{N-1} v(m)h(n-m) + z(n). \qquad \text{(form A)}$$

In (form A), h(n) represents the impulse response of the linear predictor in the current frame; v(n) represents the excitation sequence in the current frame; z(n) represents the 'zero input response', i.e., the output of the synthesis filter when the current frame is a null sequence; and each sequence is assumed to be zero outside of the segment $0 \leqq n \leqq N$. For linear predictive systems employing pitch predictive coders, the excitation sequence v(n) is typically formed by a linear combination of the displaced versions of the previous excitation sequences, u(n), as computed via block 22, added to a residual sequence, e(n). Since u(n) is null for $n \geqq 0$ extension of u(n) to $n \geqq 0$ suitably occurs by periodicization for a given period P generating $u_p(n)$, where $u_p(n)=v(n-kP)$ with k being the smallest integer such that $(n-kP)<0$ for $0 \leqq n<N$. With P as a given value of displacement, i.e., the 'basis pitch', the excitation sequence results from $$v(n)=\sum_{i=0}^{M-1} b_i u_{P+i}(n-i)+e(n), \qquad \text{(form B)}$$

with M representing the order of the pitch predictor, e.g., M=5, and $\{b_k\}$ representing the pitch predictor coefficients. The synthesized signal, s'(n), which is worked on by the decoder of the system, then results from filtering of the excitation sequence with the impulse response h(n), via filter block 24, i.e., the all pole digital filter, and added to the zero impulse response.

Figure 3:
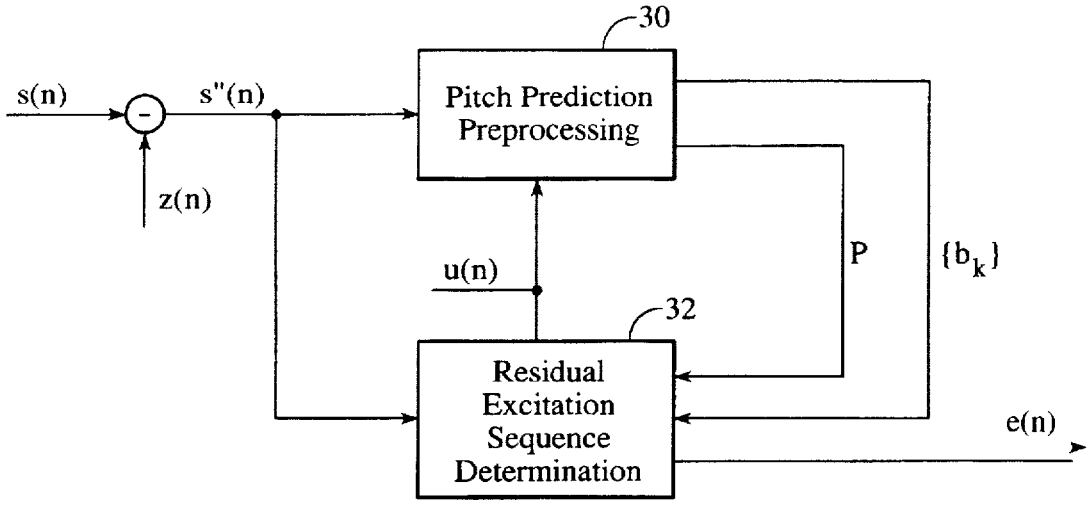
FIG. 3 (PRIOR ART)
FIG. 3 illustrates a block diagram of pitch predictor coefficient determinations in an analysis-by-synthesis linear predictive coding strategy.

FIG. 3 illustrates more particularly the overall interaction for the generation of the pitch predictor coefficients $\{b_k\}$ in the coding phase and of the excitation sequence for use in generating the synthesized signal. The zero impulse response z(n) is typically subtracted from a signal, s(n), representing the input speech relative to the current frame, which may have undergone conventional preprocessing, such as format perceptual weighting filtering and harmonic noise sharpening, to result in a residual signal s"(n). Pitch predictive coefficients, P and $\{b_k\}$, are then computed as represented by block 30 and described in more detail with reference to FIG. 4. For coding purposes, the pitch P is forced to belong to a predetermined interval $[P_0, P_1]$, while the set of pitch predictive coefficients $b=\{b_k\}$ is forced to belong to a predetermined codebook B of vectors of coefficients with the number of vectors in the codebook B indicated by B. The set of chosen coefficients are those within the codebook B that minimize an error signal, $$E=\sum_{n=0}^{N-1}(s''(n)-b_i y_{P+i}(n-i))^2, \qquad \text{(form C)}$$

where $$y_p(n)=\sum_{m=0}^{N-1} u_p(m)h(n-m).$$

With the coefficients determined, the excitation sequence v(n) is computed as represented by block 32, and as previously described with reference to FIG. 2.

Figure 4:
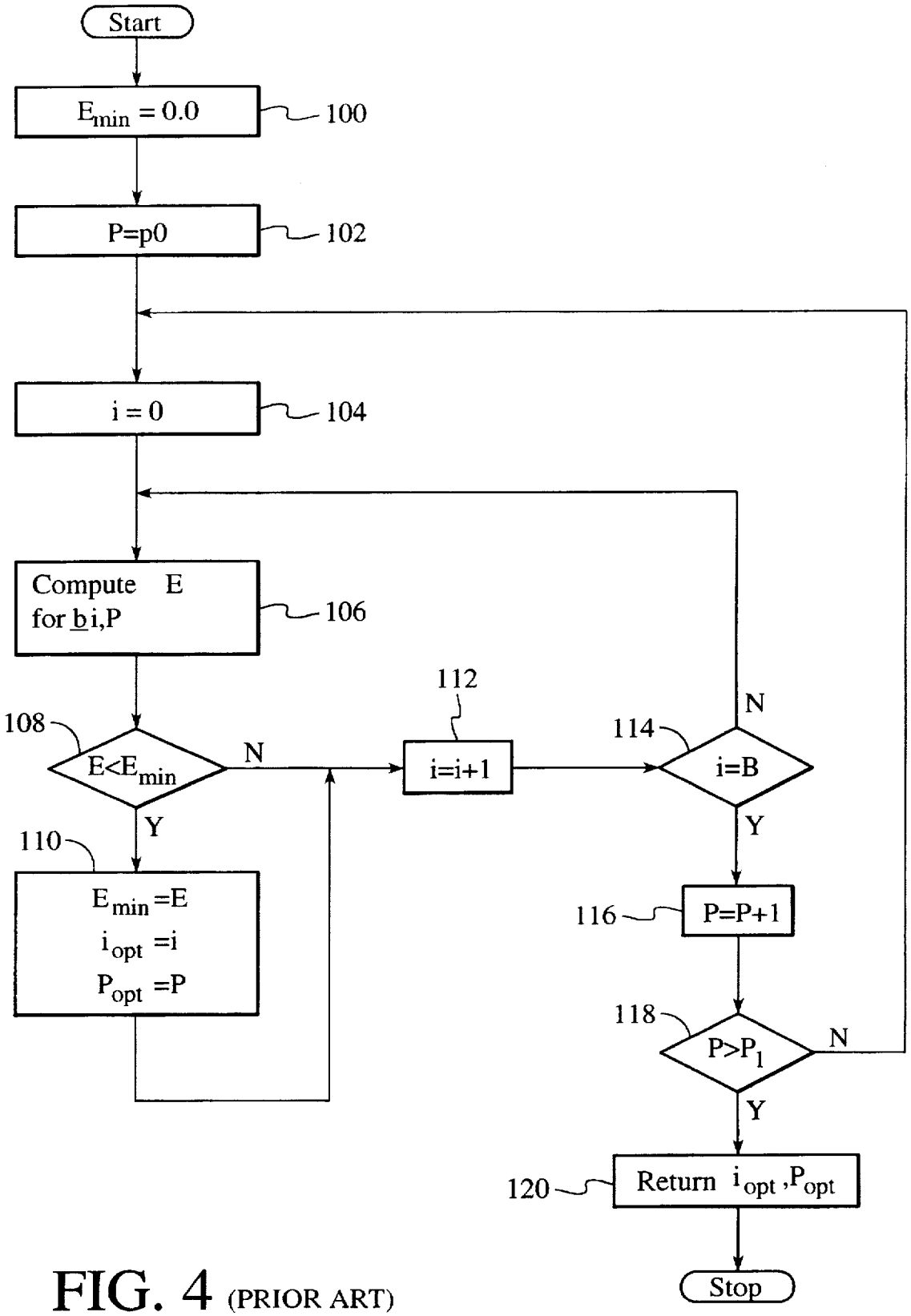
FIG. 4 (PRIOR ART)
FIG. 4 illustrates a flow diagram for conventional optimal combination pitch-coefficient determinations.

To minimize the error, as represented by (form C), the optimal pitch, P, and optimal coefficients, $\{b_k\}$, are found with the pitch parameters estimator (block 30, FIG. 3). FIG. 4 illustrates a flow chart for a typical determination of the optimal pitch and coefficients for a chosen segment of N samples, the chosen segment determined by a suitable pitch estimator, as is well known to those skilled in the art. The process suitably begins with the setting of a variable for minimum error, $E_{min}$, to infinity (step 100). The pitch variable P is appropriately initialized to one end of the predetermined pitch interval $[p_0, p_1]$, e.g., a minimum end $p_0$ (step 102). A counter variable, i, is initialized to a zero value (step 104), and represents the index of the current vector of coefficients in the codebook, $b_i$. An error value, E (form C), is suitably calculated using the value for coefficient vector $b_i$, and pitch value P (step 106). A comparison is then performed between the error value calculated, E, and the current value for the variable $E_{min}$ (step 108). When the calculated value is below the current mininum value, the variable $E_{min}$ is updated and set equal to the calculated value E, a variable $i_{opt}$ is set to the current value of i, and a variable $p_{opt}$ is set to the current pitch value P (step 110). Once the updating is completed or when E is not less than $E_{min}$, the counter variable i is then incremented (step 112), and a determination of whether the counter variable value equals the total number of codevectors, B, for the vector of coefficients is made (step 114).

When the codebook has not been exhausted, the calculation of the error, E, for the current pitch value, P, and coefficient vector in the codebook, $b_i$ is made (step 106), and the processing continues (step 108, 110, and 112) until the codebook has been exhausted. Once all of the codevectors have been utilized, the pitch variable value P is incremented (step 116). When the value of P is less than the opposite end of the pitch interval, e.g., a maximum pitch value, $p_1$, (step 118), the processing continues as described from step 104. Once the minimized error value has been found for each pitch value in the pitch interval, the optimal pitch value $P_{opt}$ and index value $i_{opt}$ for the optimal codevector in the codebook are returned (step 120), and the algorithm is completed. Thus, an optimal combination of pitch coefficients for a pitch predictive system results.

Figure 5:
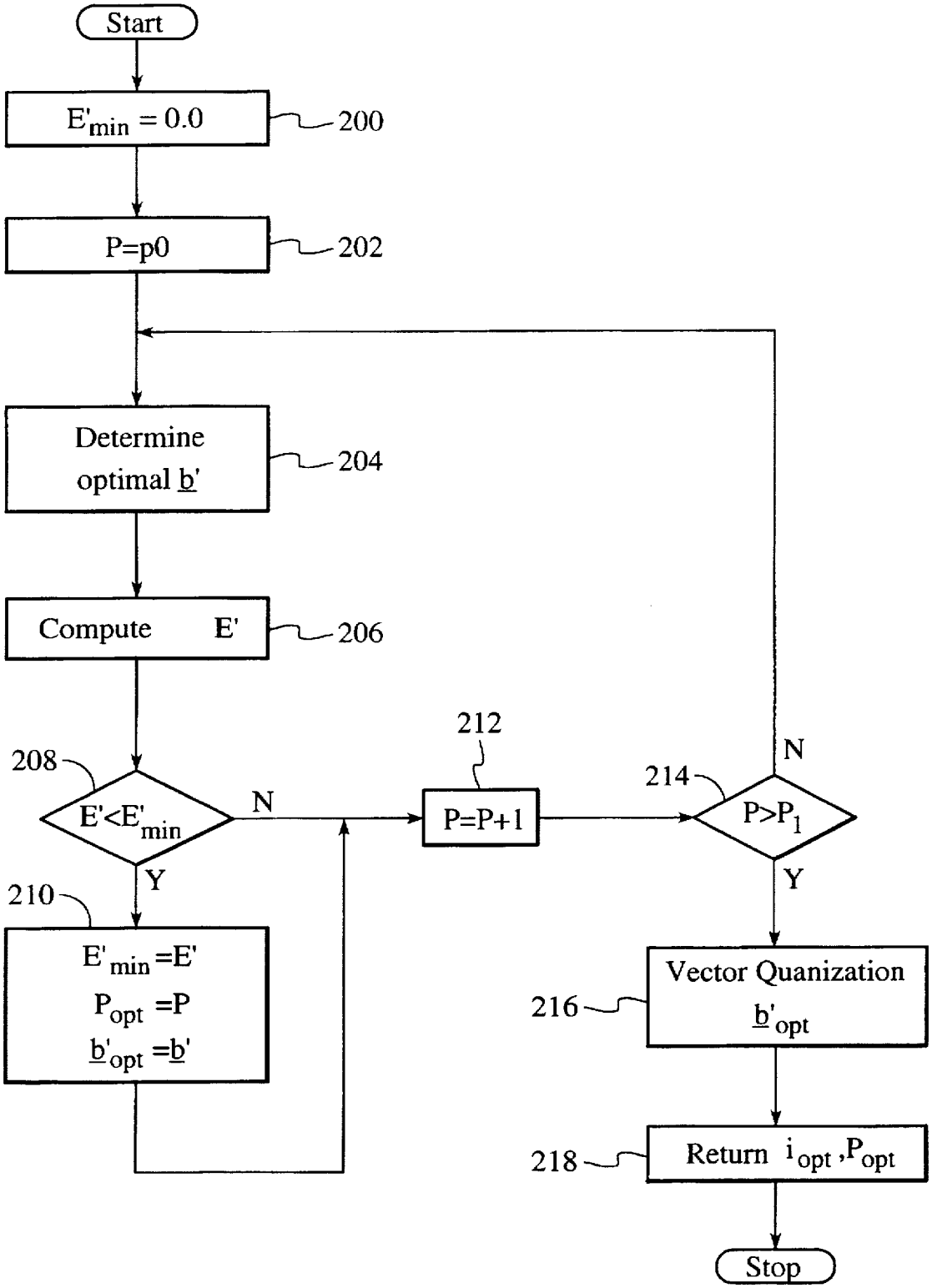
FIG. 5 illustrates a flow diagram for optimal combination pitch-coefficient determinations in accordance with the present invention.

While such algorithmic computation produces the optimal combination of pitch-coefficients, the thorough testing of the approach requires intensive computations. Intensive computations are expensive and time-consuming with the repetition of the error (form C) computation for every pitch-coefficient combination. The present invention achieves substantially equivalent results using a novel approach resulting in good quality of the decoded signal, but in a more efficient and faster manner. The flow chart of FIG. 5 illustrates a preferred embodiment of the advantageous pitch predictor coefficient determination in accordance with the present invention.

Similar to the prior art, the determination procedure begins with initialization of a variable for minimum error, $E'_{min}$, to infinity (step 200) and a pitch index variable, P, to the minimum pitch in the pitch window, $p_o$ (step 202). A determination of an optimal continuous coefficient vector, b', then occurs (step 204). In the present invention the error function is altered from the prior art to reduce the necessary calculation. Thus, for the present invention the error function is suitably represented as $$E'=\sum_{n=0}^{M-1}\left(s''(n)-\sum_{i=0}^{M-1} b'_i y_{P+q}(n-1)\right)^2; \qquad \text{(form D)}$$

where q is some value within [0, M−1], which is kept constant during the whole procedure. Further, the coefficient vector b' is not constrained to belong in the codebook B, but suitably is any vector in real space, $R^M$, with the optimal b' being the vector that minimizes E' for a given pitch P.

For a given pitch P, the optimal b' relative to (form D) is suitably computed in closed form by solving the "normal" equations associated to (form D), as is well understood to those skilled in the art, and described in "Linear Prediction of Speech", Markel, J. D., et al., Springer-Verlag, N.Y., 1976. Typically, such a procedure involves the solution of a system of the form $F^T b'=g$, where $F^T$ is the transpose of the square matrix formed by the autocorrelation terms of $y_{P+q}$ (n), and g is the vector composed by the cross-correlation terms between s'(n) and $y_{p+q}(n)$.

With the optimal b' determined, E' is suitably computed via (form D) (step 206). A comparison is performed between the computed E' and the value of $E'_{min}$ (step 208). When E' is less than $E'_{min}$, the value of $E'_{min}$ is updated to the E' value, the current pitch value P updates a variable for the optimal pitch $P_{opt}$, and the value of b' updates a variable for the optimal coefficient vector, $b'_{opt}$ (step 210). When E' is greater than $E'_{min}$ or upon completion of the variable updating, the value of P is incremented (step 212), and the procedure continues from step 204 as described, until the entire range of pitches has been tested, as determined via step 214.

Once the entire range of pitches has been tested, the saved value of $b'_{opt}$ is suitably vector quantized (step 216). A weighted vector quantization preferably occurs by determining the optimal index, $i'_{opt}$, of the codevector in the codebook B that minimizes the weighted distance, D, to $b_{opt}'$ as defined by $$D = \sum_{i=0}^{M-1} w_i(b'_i - b_i)^2. \quad \text{(form E)}$$

The weights $\{w_i\}$ are suitably chosen positive terms, such as $$w_i = \sum_{n=0}^{N-1} (y_{P+q}(n-1))^2. \quad \text{(form F)}$$

Once the vector quantization of the $b'_{opt}$ value is completed, the indexed codevector, $i'_{opt}$, and the saved value of the optimal pitch, $P_{opt}$, are returned (step 218), and the process is completed.

With the present invention, efficiency is improved by requiring computation in closed form of the continuous coefficient vector b' through the inversion of an M×M matrix. Further efficiency is possible when the M×M matrix is forced to be Toeplitz in order to use more efficient procedures to invert $F^T$, as is well understood by those skilled in the art. The weighted vector quantization procedure is required only once. Again, further efficiency is possible when a fast vector quantization scheme is used to reduce the associated computational burden. An example of a fast vector quantization scheme is described in copending U.S. patent application entitled "Method and system for searching an optimal codevector", filed Sep. 30, 1996, Ser. No. 08/723,005, and assigned to the assignee of the present invention. The present invention thus reduces the computational burden by implementing only a single nested loop, rather than the two nested loops in the conventional exhaustive computation, while achieving substantially equivalent results.

Figure 6:
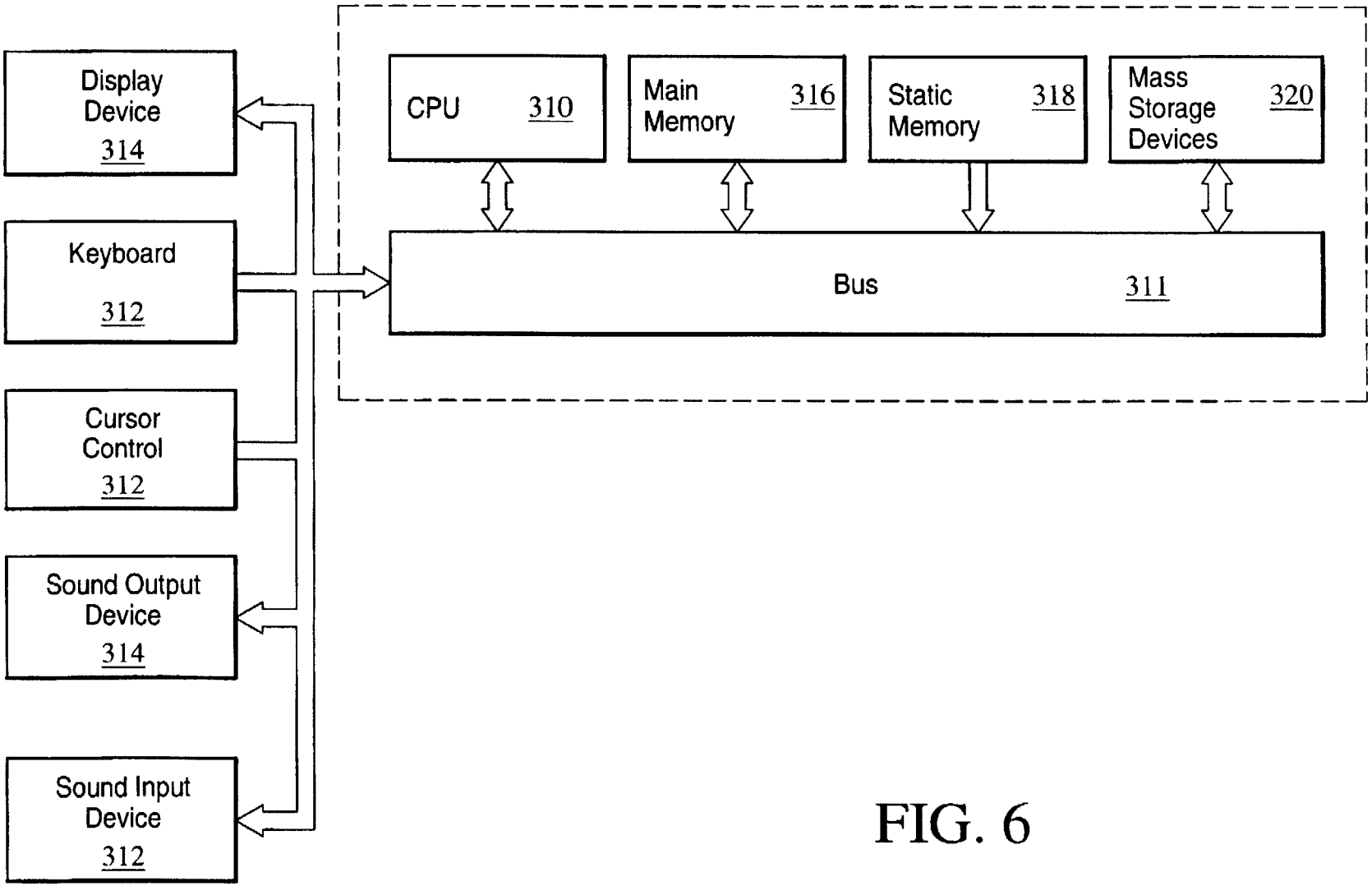
FIG. 6 illustrates a block diagram of a computer system suitable for use in implementing the present invention.

Such advantageous determination are suitably performed by and implemented in a computer system, e.g., the computer system of FIG. 6, which illustrates a block diagram of a computer system capable of coordinating speech processing including the pitch-coefficient determination in accordance with the present invention. Included in the computer system are a central processing unit (CPU) 310, coupled to a bus 311 and interfacing with one or more input devices 312, including a cursor controlmouse/stylus device, keyboard, and speech/sound input device, such as a microphone, for receiving speech signals. The computer system further includes one or more output devices 314, such as a display device/monitor, sound output device/speaker, printer, etc, and memory components, 316, 318, e.g., RAM and ROM, as is well understood by those skilled in the art. Of course, other components, such as A/D converters, digital filters, etc., are also suitably included for speech signal generation of digital speech signals, e.g., from analog speech input, as is well appreciated by those skilled in the art. The computer system preferably controls operations necessary for the speech processing including the pitch prediction of the present invention, suitably performed using a programming language, such as C, C++, and the like, and stored on an appropriate storage medium 320, such as a hard disk, floppy diskette, etc.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A method for linear predictive speech encoding comprising the steps of:

a) defining an error function that includes a constant value, the constant value comprising a chosen offset within a predetermined pitch interval;

b) determining an optimal continuous vector;

c) determining an error from the optimal continuous vector;

d) determining if the error is less than a minimum error;

e) providing optimal combination pitch-continuous coefficient values based upon in the minimum error; and f) providing a weighted vector quantization of an optimal continuous vector of continuous coefficient values.

2. A method for linear predictive speech encoding comprising the steps of:

a) defining an error function that includes a constant value; wherein the constant value comprises a chosen offset within a predetermined pitch interval;

b) determining an optimal continuous vector;

c) determining an error from the optimal continuous vector;

d) determining if the error is less than a minimum error;

e) providing optimal combination pitch-continuous coefficient values based upon in the minimum error;

f) providing a weighted vector quantization of an optimal continuous vector of continuous coefficient values; and g) performing steps b)–d) over a predetermined pitch interval.

3. A system for providing combination pitch-coefficients with improved efficiency in linear predictive speech encoding, the system comprising:

speech signal generation means for generating speech signals; and speech processing means for processing the generated speech signals with linear predictive speech encoding, the processing further comprising:

a) defining an error function that includes a constant value, the constant value comprising a chosen offset within a predetermined pitch interval;

b) determining an optimal continuous vector:

c) determining an error from the optimal continuous vector;

d) determining if the error is less than a minimum errors;

e) providing optimal combination pitch-continuous coefficient values resulting in the minimum error; and f) calculating a weighted vector quantization of an optimal continuous vector of continuous coefficient values.

4. The system of claim 3 further comprising performing steps b)–d) over a predetermined pitch interval.

5. A method for providing combination pitch coefficients with improved efficiency in a linear predictive speech encoding system, the method comprising:

limiting calculation at a chosen offset from a given pitch in an error function calculation;

determining one or more continuous coefficient vectors from any vector in real space; and determining an optimal combination pitch-continuous coefficient vector that minimizes the error function calculation.

6. The method of claim 5 further comprising performing weighted vector quantization of the optimal continuous vector of continuous coefficient values.

7. A system for providing combination pitch coefficients with improved efficiency in linear predictive speech encoding, the system comprising:

a speech generator of speech signals; and a central processing unit, the central processing unit coupled to the speech generator and capable of coordinating a limitation of calculation at a chosen offset from a given pitch in an error function calculation, a determination of one or more continuous coefficient vectors from any vector in real space, and a determination of an optimal combination pitch-continuous coefficient vector that minimizes the error function calculation.

8. The system of claim 7 wherein the central processing unit further coordinates performing weighted vector quantization of the optimal continuous vector of continuous coefficient values.

9. A computer readable medium containing program instructions for linear predictive speech encoding, the program instructions comprising:

a) defining an error function that includes a constant value, the constant value comprising a chosen offset within a predetermined pitch interval;

b) determining an optimal continuous vector;

c) determining an error from the optimal continuous vector;

d) determining if the error is less than a minimum error;

e) providing optimal combination pitch-continuous coefficient values based upon the minimum error; and f) providing a weighted vector quantization of an optimal continuous vector of continuous coefficient values.

10. A computer readable medium containing program instructions for linear predictive speech encoding, the program instructions comprising:

a) defining an error function that includes a constant value;

b) determining an optimal continuous vector;

c) determining an error from the optimal continuous vector;

d) determining if the error is less than a minimum error;

e) providing optimal combination pitch-continuous coefficient values based upon the minimum error;

f) providing a weighted vector quantization of an optimal continuous vector of continuous coefficient values; and g) performing steps b)–d) over a predetermined pitch interval.

11. A computer readable medium containing program instructions for linear predictive speech encoding, the program instructions comprising:

limiting calculation at a chosen offset from a given pitch in an error function calculation;

determining one or more continuous coefficient vectors from any vector in real space; and determining an optimal combination pitch-continuous coefficient vector that minimizes the error function calculation.

12. The program instructions of claim 11 further comprising performing weighted vector quantization of the optimal continuous vector of continuous coefficient values.

* * * * *